US007683753B2

(12) United States Patent
Yoshida et al.

(10) Patent No.: US 7,683,753 B2
(45) **Date of Patent: *Mar. 23, 2010**

(54) VOLTAGE NON-LINEAR RESISTANCE CERAMIC COMPOSITION AND VOLTAGE NON-LINEAR RESISTANCE ELEMENT

(75) Inventors: Naoyoshi Yoshida, Nikaho (JP); Hitoshi Tanaka, Nikaho (JP); Dai Matsuoka, Nikaho (JP)

(73) Assignee: TDK Corporation, Tokyo (JP)

( * ) Notice: Subject to any disclaimer, the term of this patent is extended or adjusted under 35 U.S.C. 154(b) by 32 days.

This patent is subject to a terminal disclaimer.

(21) Appl. No.: 12/076,922

(22) Filed: Mar. 25, 2008

(65) Prior Publication Data

US 2008/0238605 A1 Oct. 2, 2008

(30) Foreign Application Priority Data

Mar. 30, 2007 (JP) ..... 2007-092712

(51) Int. Cl.
*H01C 7/10* (2006.01)

(52) U.S. Cl. ..... 338/21; 338/22 R; 338/309; 252/519.5

(58) Field of Classification Search ..... 338/21, 338/22 R; 252/519.5, 519.51
See application file for complete search history.

(56) References Cited

U.S. PATENT DOCUMENTS 5,854,586 A * 12/1998 McMillan et al. ..... 338/21
6,813,137 B2 * 11/2004 Matsuoka et al. ..... 361/305

FOREIGN PATENT DOCUMENTS

JP A 2002-246207 8/2002
JP B2-3493384 11/2003

* cited by examiner

*Primary Examiner*—Kyung Lee
(74) *Attorney, Agent, or Firm*—Oliff & Berridge, PLC

(57) ABSTRACT

As for the voltage non-linear resistance element layer 2, sintered body (ceramics) having ZnO as main component is used. Said sintered body comprises Pr, Co, Ca and Na are added. Therefore, the ranges are 0.05 to 5.0 atm % of Pr, 0.1 to 20 atm % of Co, 0.01 to 5.0 atm % of Ca and 0.0001 to 0.0008 atm % of Na. When it is within the range, the capacitance changing rate at 85° C. with standard being 25° C. can be made to equal or less than 10%.

12 Claims, 6 Drawing Sheets

I : PRE-BREAKDOWN REGION
II : BREAKDOWN REGION
III : OHMIC REGION

VOLTAGE NON-LINEAR RESISTANCE CERAMIC COMPOSITION AND VOLTAGE NON-LINEAR RESISTANCE ELEMENT

BACKGROUND OF THE INVENTION

1. Field of the Invention

The present invention relates to a voltage non-linear resistance composition mainly used to protect the semiconductor or electrical circuit from the surge or noise; and voltage non-linear resistance element using thereof.

2. Description of the Related Art

Recently, electrical circuits made of semiconductor, LSI and etc has advanced in high performance; and it has been used in many purposes and environments. However, in many cases, these semiconductors and electrical circuits work at low voltage, and if excessive voltage is applied, these were liable to be destroyed. Especially, abnormal surge voltage and noise due to lightning, the electrostatic is discharged. The voltage thereof will be applied to the semiconductor element or so and it can be destroyed. These problems are particularly prominent in portable devices used in various environments.

In order to overcome such situations, protective element is set in parallel connection to the semiconductor element in many cases. This protective element has large resistance when normal voltage is applied to the above semiconductor element, thus the current will flow mainly to the above semiconductor element allowing this semiconductor element to run properly. On the other hand, when excessive voltage is applied, the resistance of this protective element will decline. Due to this, the current will flow mainly to the protective element suppressing excessive current to flow into this semiconductor element. Therefore, this semiconductor element is protected from being destroyed by the flow of excessive current.

The current-voltage characteristics of these protective elements must have non-linear characteristics. That is, the resistance changes depending on the voltage, and for example, it has characteristics such as the dramatic decline of the resistance at above certain voltage. Zener diode and varistor (voltage non-linear resistance element) are known as an element obtaining such characteristics. Compared to the zener diode, varistor has no polarity in the movement, has higher surge resistance, and is easier to make it compact; hence it is specially preferred to be used.

As for the varistor, various materials (voltage non-linear resistance ceramic composition) are used, however particularly the sintered body having the ZnO as the main component is preferably used due to the cost and the size of the non-linearity (for example, Japanese Patent No. 3493384 and Japanese Unexamined Publication No. 2002-246207). An example of current-voltage (logarithm) characteristics in a varistor is shown in FIG. 6. The resistance significantly declines at voltage larger than the breakdown area, and the current becomes larger. The voltage (V1mA) which makes the current 1 mA is called varistor voltage, and when the voltage exceeds thereof, large current will flow. The varistor voltage is higher than the voltage which the semiconductor works properly (for example 3V or so), and varistor voltage is set accordingly to the voltage which the difference between this voltage is not too big.

In these voltage non-linear resistance ceramic compositions, the main component is set to ZnO; and as dopant to give conductivity and non-linearity of current-voltage or so, Pr (rare earth element), Co, Al (IIIb group element), K (Ia group element), Cr, Ca, and Si are added to this. By controlling these concentrations, improvements in varistor lifetime (Japanese Patent No. 3493384), and lowering of non-uniform production of varistor (Japanese Unexamined Publication No. 2002-246207) are accomplished.

SUMMARY OF THE INVENTION

These varistors are incorporated in the device (circuit) for example, in parallel-connection to form the semiconductor element to be used. In this case, besides the resistance of the varistor, for example, the capacitance characteristics thereof give influence to the characteristics of this circuit. However, when the temperature of the devices is changed greatly, this capacitance characteristic will be changed greatly as well. Due to this, designing the circuit incorporating the varistor became difficult.

The present invention was accomplished reflecting such problems, and the objective is to provide an invention solving above mentioned problems.

The present invention has following constitution to solve above objectives. The voltage non-linear resistance ceramic composition according to the first aspect of the present invention is characterized by having zinc oxide as main component; and includes 0.05 to 5 atm % of Pr, 0.1 to 20 atm % of Co, 0.01 to 5 atm % of Ca, and 0.0001 to 0.0008 atm % of Na.

The voltage non-linear resistance ceramic composition according to the second aspect of the present invention is characterized by having zinc oxide as main component; and includes 0.05 to 5 atm % of Pr, 0.1 to 20 atm % of Co, 0.01 to 5 atm % of Ca, 0.0001 to 0.0008 atm % of Na, 0.001 to 1 atm % of K, 0.001 to 0.5 atm % of Al, 0.01 to 1 atm % of Cr, and 0.001 to 0.5 atm % of Si.

The voltage non-linear resistance element according to the present invention is characterized by comprising above voltage non-linear resistance ceramic composition.

The voltage non-linear resistance element according to the present invention preferably comprises sintered body of the above voltage non-linear resistance ceramic composition and plurality of electrodes connected to said sintered body.

The voltage non-linear resistance element according to the present invention is characterized by preferably comprising a multilayer structure wherein a resistance element layer comprised of said voltage non-linear resistance composition and internal electrodes are stacked alternately; and a pair of external terminal electrode which is connected to said internal electrode facing each other across said resistance element layer is formed on the side end of said multilayer structure.

The present invention was constituted as above to obtain a voltage non-linear resistance element with small capacitance fluctuation at temperature changes.

DESCRIPTION OF THE PREFERRED EMBODIMENTS

Hereafter, the embodiment of the present invention will be described.

Figure 1:
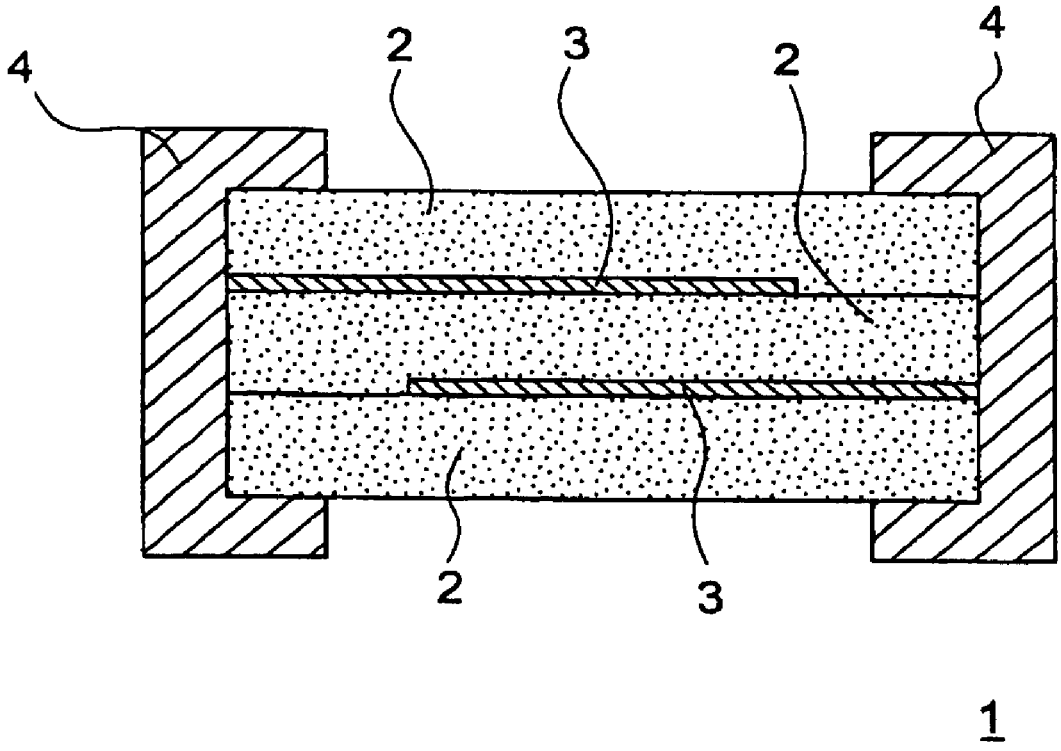
FIG. 1 is a sectional view of the voltage non-linear resistance element according to the preferred embodiment of the present invention.

FIG. 1 illustrates the voltage non-linear resistance element structure according to the first embodiment of the present invention. This voltage non-linear resistance element (varistor) 1 is comprised of voltage non-linear resistance element layer 2 separated in 3 layers, internal electrode 3 sandwiched between the voltage non-linear resistance element layers and external terminal electrode 4 connected to the internal electrode 3. The size of this is not particularly limited; however as for the whole size of voltage non-linear resistance element 1 is length (0.4 to 5.6 mm)×width (0.2 to 5.0 mm)×thickness (0.2 to 1.9 mm) or so. This size is equivalent to the size of stacked entire voltage non-linear resistance element layer 2.

The voltage non-linear resistance element layer 2 is comprised of voltage non-linear resistance ceramic composition which is a sintered body having ZnO as main component. The detail will be described later on.

For the material of internal electrode 3, metal (conductive material) having good interface characteristics with voltage non-linear resistance element layer 2 and capable of having good electrical connection with said voltage non-linear resistance element layer 2 is used. Therefore, precious metal such as Pd (paradium), Ag (silver), or alloy of Pd and Ag is preferred to be used. The thickness of the internal electrode 3 is determined accordingly, however 0.5 to 5 μm or so is preferred. Also, the distance between the internal electrodes 3 is 5 to 50 μm or so.

The material for the external terminal electrode 4 is also not particularly limited; however similar to internal electrode 3, Pd, Ag or alloy of Ag Pd is used. The thickness is determined accordingly, however 10 to 50 μm is preferred.

In this voltage non-linear resistance element 1, the resistance between a pair of internal electrodes 3 fluctuates depending on the applied voltage. That is, the current-voltage characteristic between internal electrodes fluctuates non-linearly. Especially when the voltage becomes high, the current becomes larger non-linearly. Thus, if a pair of external terminal electrode 4 was parallel-connected to external semiconductor, and when excessive voltage is applied to this semiconductor, the current can mainly flow into this voltage non-linear resistance element 1 allowing to protect the semiconductor element.

As for the basic structure of voltage non-linear resistance element, voltage non-linear resistance element layer and plurality of electrodes connected to this are sufficient enough. The voltage non-linear resistance element layer is preferably composed of a sintered body of the voltage non-linear resistance ceramic composition. In the constitution illustrated in FIG. 1, plurality of the electrodes are formed by forming multilayer structure wherein this sintered body and internal electrodes 3 are stacked in alternating manner. Each internal electrode 3 is connected to the external terminal electrode 4 formed on the side end of this multilayer body.

Above constitution is also described in Japanese Unexamined Publication No. 2002-246207, hence the detailed description will be omitted.

In the voltage non-linear resistance element according to the present invention, the characteristics thereof are improved by controlling the dopants added to the voltage non-linear resistance ceramic composition. Note that, the structure of voltage non-linear resistance element is not limited to the embodiment illustrated in FIG. 1. If similar voltage non-linear resistance element layer is used, similar effect can be obtained. For the voltage non-linear resistance ceramic composition, it is required to have small capacitance characteristics fluctuations at temperature changes while maintaining good current-voltage characteristics.

In order to fulfill such requirements, as for the voltage non-linear resistance ceramic composition, a sintered body (ceramics) having ZnO as main component is used. Pr (praseodymium), Co (cobalt), Ca (calcium), and Na (sodium) are added to this sintered body. Furthermore, K (potassium), Al (aluminum), Cr (chromium) and Si (silicon) can be added as well.

Pr has larger ionic radius than that of Zn, hence it is difficult to enter the ZnO crystals of sintered body, and thus it will accumulate in crystal grain boundary. Due to this, the electron movement is interfered at the crystal grain boundary causing the non-linearity of current-voltage characteristics. That is, non-linearity is obtained by the addition of Pr, and the appropriate varistor voltage is set by the adequate amount of addition of Pr. Similarly, Co, Ca, and Cr improve the non-linearity, and adequate amount of addition allows controlling the varistor voltage.

Figure 6:
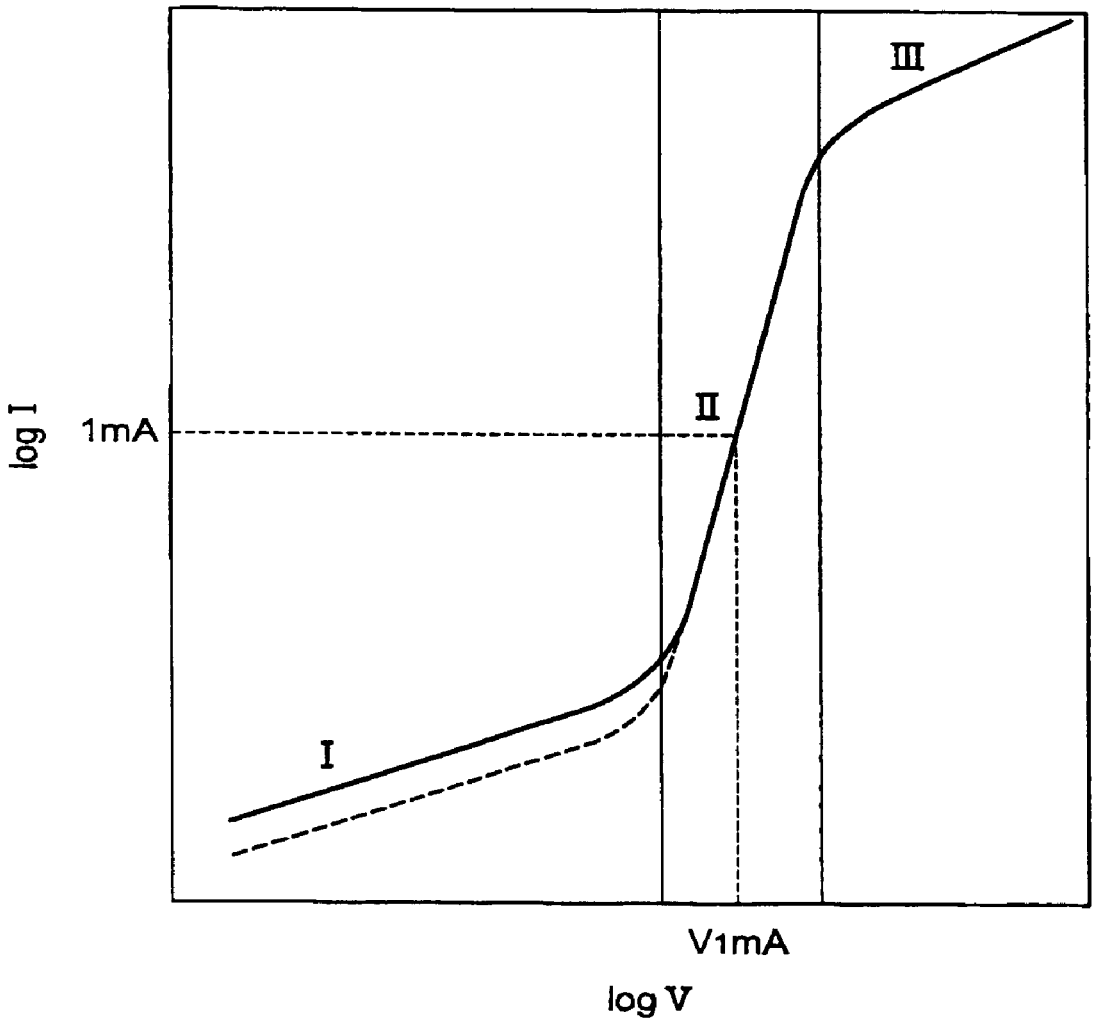
FIG. 6 is an example of current-voltage characteristics of the voltage non-linear resistance element.

Also, Al (IIIb group element) functions as donor in ZnO and cause conductivity. Therefore, due to this Al addition, it becomes possible to flow large current in the ohmic region shown in FIG. 6. However, if the amount of the addition is too much, the leakage current becomes large as well. Note that the conductivity in ZnO is caused by interstitial Zn.

Unlike Pr, Na is solid-soluble in ZnO crystals. Due to this, the defective structure in ZnO crystals is prevented. Therefore, leakage current is influenced particularly by this concentration. The leakage current can be made small depending on this addition; however the varistor voltage will also be influenced at the same time. K and Si have similar influence as well.

The inventors have found a range wherein the capacitance fluctuation is small during the temperature fluctuations while maintaining a good current-voltage characteristics by controlling the concentrations of above dopants.

These concentrations ranges are; 0.05 to 5.0 atm % of Pr, 0.1 to 20 atm % of Co, 0.01 to 5.0 atm % of Ca, and 0.0001 to 0.0008 atm % of Na. When the concentrations are in these ranges, the capacitance changing rate can be made to 10% or less at 85° C. when 25° C. is set as standard. Also, within this composition range, the dielectric tangent loss (tan δ) at 85° C. can be made to 15% or less, preferably 13% or less. Thus, within this composition ranges, the capacitance changing rate during the temperature fluctuations becomes significantly small and the dielectric tangent loss becomes small as well. Therefore the capacitance changing rate during the temperature fluctuations of this voltage non-linear resistance element becomes small enabling to design the device using this more easily.

Also, when 0.001 to 1.0 atm % of K, 0.001 to 0.5 atm % of Al, 0.01 to 1.0 atm % of Cr and 0.001 to 0.5 atm % of Si were further added, similar effect was obtained.

Therefore, when using the sintered body added with the additives with respect to ZnO in the above composition ranges as the voltage non-linear resistance ceramic composition, it becomes easy to design a device using this voltage non-linear resistance element. Note that the ZnO as the main component is preferably 85% or less in conversion with atm % of Zn alone, and preferably 94% or less is included in the sintered body.

Next, an example of production method of this voltage non-linear resistance element 1 will be described.

The voltage non-linear resistance ceramic composition used in this voltage non-linear resistance element is a sintered body. Actually, it is preferably formed by sintering the stacked three voltage non-linear resistance element layers 2 and a pair of internal electrodes 3 as a whole. Therefore, for example, usual printing method and sheet method using paste is used to form a green chip, followed by firing to obtain the sintered body wherein the voltage non-linear resistance element layer 2 and internal electrodes 3 are stacked. Then, the external terminal electrodes 4 can be produced by printing method or transcription method followed by firing. Hereafter, the production method will be explained in detail.

First, the voltage non-linear resistance ceramic composition paste, the internal electrode paste, and the external terminal electrode paste are prepared.

The voltage non-linear resistance ceramic composition paste can be organic paste wherein voltage non-linear resistance ceramic composition materials and organic vehicle are kneaded or water based paste.

Depending on the composition of above mentioned voltage non-linear resistance ceramic composition, the materials constituting main component (ZnO) and materials constituting each additive components are combined in the voltage non-linear resistance ceramic composition. That is, as for the materials, ZnO powder which is a main component; and the powders of oxides, carbonate, oxalate, hydroxides, and nitrate which are made of additive element $Pr_6O_{11}$, $CO_3O_4$, $CaCO_3$, $Na_2CO_3$, $K_2CO_3$, $Al_2O_3$, $Cr_2O_3$, and $SiO_2$, are mixed. The particle size of ZnO powder can be 0.1 to 5 μm or so, and particle size of additive component powder can be 0.1 to 3 μm or so.

Organic vehicle is obtained by dissolving binder in organic solvent. The binder used in the organic vehicle is not particularly limited, and it can be suitably selected from variety of normal binders such as ethyl cellulose, or polyvinyl butyral. Also, the organic solvent used for organic vehicle is not particularly limited, and can be suitably selected from organic solvents such as terpineol, butyl carbitol, aceton and toluene depending on the method used such as printing method and sheet method.

Also, as for the water based paste, aqueous binder and parting agent are dissolved in the water. Aqueous binder is not particularly limited, and it can be suitably selected from polyvinyl alcohol, cellulose, aqueous acrylic resin, and emulsion.

Internal electrode paste is made by kneading the above mentioned respective conductive material such as Pd or variety of oxides, organic metal compound, and resinates which becomes above mentioned conductor after firing with the above mentioned organic vehicle. Also, the external terminal electrode paste is made as this internal electrode paste.

The content of organic vehicle in each paste is not particularly limited, and it can be usual content, such as 1 to 5 wt % or so of binder and 10 to 50 wt % or so of solvent. Also, additives selected from respective parting agents, plasticizer, dielectric body, and insulator can be included in each paste if necessary.

When using printing method, the voltage non-linear resistance ceramic composition paste is printed several times in a predetermined thickness on the substrate made of polyethylene terephthalate to form lower layer of voltage non-linear resistance layer 2 shown in FIG. 1. Next, internal electrode paste is printed in predetermined pattern thereon to form lower internal electrode 3 which is in green state.

Next, on to this internal electrode 3, similar to the above, the voltage non-linear resistance ceramic composition paste is printed several times in predetermined thickness to form middle layer of voltage non-linear resistance layer 2 shown in FIG. 1.

Next, internal electrode paste is printed in predetermined pattern thereon to form upper internal electrode 3. Internal electrode 3 is printed so that it is exposed to the surface of the end portions opposing each other.

Finally, on to the upper internal electrode 3, similar to the above, voltage non-linear resistance ceramic composition paste is printed several times in predetermined thickness to form the upper layer of the voltage non-linear resistance element layer 2 shown in FIG. 1. Then, it is subject to pressing while heating, press bonded and cut into predetermined formation to form green chip.

In case of using sheet method, voltage non-linear resistance ceramic composition paste is used to form green sheet. Then, predetermined numbers of these green sheets are stacked to form the lower layer of the voltage non-linear resistance element layer 2 shown in FIG. 1. Next, the internal electrode paste is printed in predetermined pattern thereon to form internal electrode 3 which is in green state.

Similarly, internal electrode 3 is formed on the upper layer of the voltage non-linear resistance element layer 2 shown in FIG. 1. The middle layer of the voltage non-linear resistance element layer 2 shown in FIG. 1 is sandwiched between these, and also it is stacked so that each internal electrode 3 is exposed to the surface of opposed end portions, followed by heat press, press bonding and cut into predetermined formation to form green chip.

Next, this green chip is subject to the binder removal process and firing, and the sintered body (structure wherein three voltage non-linear resistance element layer 2 and a pair of internal electrodes 3 are stacked) are made.

Binder removal process can be performed under usual conditions. For example, it can be performed under air atmosphere, 5 to 300° C./hour or so of temperature rising rate, 180 to 400° C. or so of holding temperature, and 0.5 to 24 hour or so of temperature holding time.

The firing of green chip can be performed under usual conditions. For example, it can be under air atmosphere, 50 to 500° C./hour or so of temperature rising rate, 1000 to 1400° C. or so of holding temperature, 0.5 to 8 hours or so of temperature holding time, and 50 to 500° C./hour or so of cooling rate. If the holding temperature is too low, the densification becomes insufficient. If the holding temperature is too high, abnormal sintering of internal electrode occurs and internal electrode may be segmented.

Obtained sintered body is subject to the end surface polishing for example by barrel polishing or sand blast, and external terminal electrode paste is printed or transcribed followed by firing to form external terminal electrode 4. The firing condition of the external terminal electrode is preferably, for example, under air atmosphere with 600 to 900° C. for 10 minutes to 1 hour or so.

EXAMPLES

The voltage non-linear resistance element using ZnO sintered body as voltage non-linear resistance element layer wherein said additive component concentrations are within the said composition range was set as examples in the following. Similarly, said element using ZnO sintered body wherein the additive component concentrations were out of said ranges were set as comparative examples. The examined results are shown.

The size of voltage non-linear resistance element layer produced here is 1.6 mm×0.8 mm×0.8 mm. The production method was said sheet method and the sintering of the voltage non-linear resistance element layer and etc were performed under air atmosphere, 300° C./hour of temperature rising rate, 1250° C. of holding temperature, 300° C./hour of cooling rate. Internal electrode was Pd and the external terminal electrode was Ag.

The varistor voltage, the leakage current, the capacitance changing rate, the dielectric tangent loss of respective samples were measured in the following.

The varistor voltage is defined as the voltage (V1mA) which makes the current 1 mA. That is, when this voltage non-linear resistance element is connected parallel to semiconductor element, and when the voltage exceeding the varistor voltage is applied, the current will flow mainly to the voltage non-linear resistance element and protect the semiconductor element.

The capacitance changing rate is a changing rate (ΔC/C) at 85° C. taking the standard at 25° C. Dielectric tangent loss (tan δ) is a value at 85° C. The capacitance and dielectric tangent loss were measured by LCR meter HP4184A made by HP company. In order to make the designing of the device having this voltage non-linear resistance element easier, these values are preferably small.

The leakage current was set to the current (Id) when applied voltage was 3 V. That is, this leakage current is a current which flow the voltage non-linear resistance element at the voltage semiconductor is normally used; hence it is preferred to be small.

As for the evaluation criteria, it was evaluated as "PASS" when the capacitance changing rate (ΔC/C) was 10% or less, the dielectric tangent loss (tan δ) was 15% or less, and leakage current was 10 nA or less at 3 V. If any one of the criteria was out of the above ranges, it was evaluated as "FAIL".

Table 1 shows the measurement result when Pr, Co, and Ca concentrations were set constant to 2.0, 5.0, and 0.2 atm % respectively, while changing the Na concentration.

Figure 2:
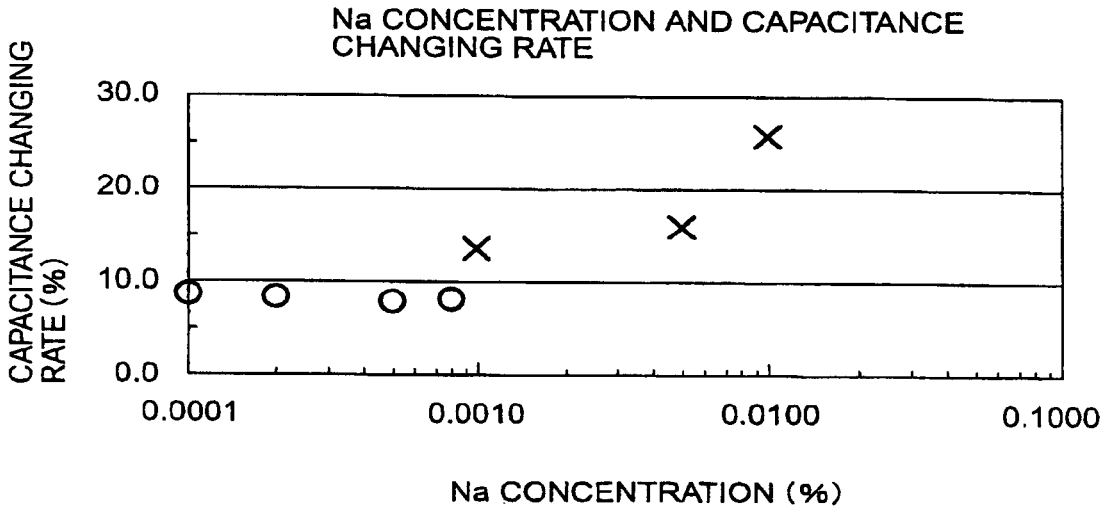
FIG. 2 is a graph showing Na concentration dependency of the capacitance changing rate of the voltage non-linear resistance element according to the example of the present invention.

Also, the graph of FIG. 2 indicates the relationship between the capacitance changing rate and Na concentration. From these results, when Na concentration is within the range of 0.0001 to 0.0008 atm % (examples 1 to 4), the capacitance changing rate and dielectric tangent loss showed low values which were 10% or less and 15% or less respectively. The leakage current was also maintained 10 nA or less (the actual values were less than 5%). At this condition, the varistor voltage was all the same.

In comparative examples 1 to 4, although the varistor voltages were the same, the capacitance changing rate, the dielectric tangent loss, and the leakage current were all larger than those of examples.

TABLE 1

| Samples | Zn atm % | Co atm % | Pr atm % | Ca atm % | Na atm % | V1mA (V) | Id(3 V) (nA) | ⊿C/C (85° C. (%) | tan δ @85° C. (%) | Evaluation |
|---|---|---|---|---|---|---|---|---|---|---|
| Comparative Example 1 | 92.8000 | 5.0000 | 2.0000 | 0.2000 | 0.0000 | 8.4 | 87.0 | 15.6 | 21.1 | fail |
| Example 1 | 92.7999 | 5.0000 | 2.0000 | 0.2000 | 0.0001 | 8.2 | 2.2 | 8.7 | 10.1 | pass |
| Example 2 | 92.7998 | 5.0000 | 2.0000 | 0.2000 | 0.0002 | 8.1 | 2.9 | 8.5 | 9.5 | pass |
| Example 3 | 92.7995 | 5.0000 | 2.0000 | 0.2000 | 0.0005 | 8.2 | 1.8 | 7.9 | 9.2 | pass |
| Example 4 | 92.7992 | 5.0000 | 2.0000 | 0.2000 | 0.0008 | 7.9 | 3.7 | 8.1 | 9.3 | pass |
| Comparative Example 2 | 92.7990 | 5.0000 | 2.0000 | 0.2000 | 0.0010 | 8.1 | 66.1 | 13.5 | 19.8 | fail |
| Comparative Example 3 | 92.7950 | 5.0000 | 2.0000 | 0.2000 | 0.0050 | 7.8 | 78.2 | 16.1 | 27.8 | fail |
| Comparative Example 4 | 92.7900 | 5.0000 | 2.0000 | 0.2000 | 0.0100 | 8.3 | 67.1 | 25.9 | 45.8 | fail |

Table 2 shows the measurement results when Co and Ca concentrations were set constant to 5.0 and 0.2 atm % respectively, while changing the concentration of Pr. In examples 5 to 11 and comparative examples 5 and 6, the Na concentration was set constant to 0.0005 atm %.

Also, in examples 12 to 15, the Na concentrations were either set to 0.0001 atm % or 0.0008 atm %.

Figure 3:
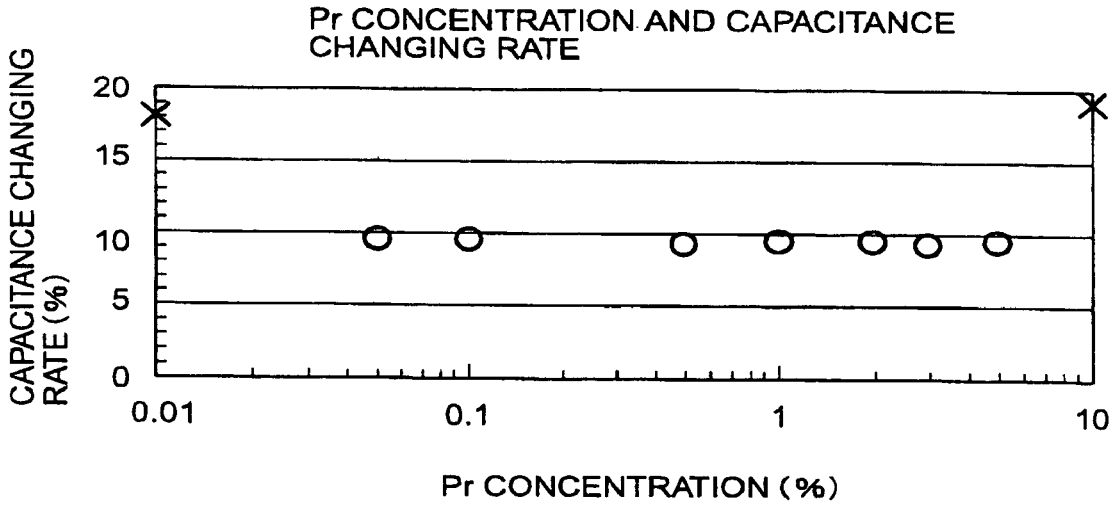
FIG. 3 is a graph showing Pr concentration dependency of the capacitance changing rate of the voltage non-linear resistance element according to the example of the present invention.

The graph of FIG. 3 illustrates the relationship between the capacitance changing rate and Pr concentration of example 5 to 11 and comparative examples 5 and 6.

From these results, the capacitance changing rate and the dielectric tangent loss were 10% or less and 15% or less respectively, when Pr concentration were 0.05 to 5.0 atm %. At the same time, the leakage current was also maintained to 10 nA or less (in fact it was less than 5 nA). At this condition, the varistor voltages were all the same. In comparative examples 5 and 6, although the varistor voltage was the same, the capacitance changing rate, the dielectric tangent loss and the leakage current were larger compared to that of examples.

Also, even in the case wherein the Na concentration were either set to 0.0001 atm % or 0.0008 atm %, the same effect was obtained with this Pr concentration.

TABLE 2

| Samples | Zn atm % | Co atm % | Pr atm % | Ca atm % | Na atm % | V1mA (V) | Id(3 V) (nA) | ⊿C/C (85° C.) (%) | tan δ @85° C. (%) | Evaluation |
|---|---|---|---|---|---|---|---|---|---|---|
| Comparative Example 5 | 94.7895 | 5.0000 | 0.0100 | 0.2000 | 0.0005 | 8.2 | 108.0 | 18.1 | 17.9 | fail |
| Example 5 | 94.7495 | 5.0000 | 0.0500 | 0.2000 | 0.0005 | 8.0 | 2.0 | 9.4 | 10.1 | pass |
| Example 6 | 94.6995 | 5.0000 | 0.1000 | 0.2000 | 0.0005 | 8.1 | 2.1 | 9.5 | 9.8 | pass |
| Example 7 | 94.2995 | 5.0000 | 0.5000 | 0.2000 | 0.0005 | 8.1 | 2.1 | 9.3 | 9.5 | pass |
| Example 8 | 93.7995 | 5.0000 | 1.0000 | 0.2000 | 0.0005 | 7.9 | 2.3 | 9.4 | 9.6 | pass |
| Example 9 | 92.7995 | 5.0000 | 2.0000 | 0.2000 | 0.0005 | 8.0 | 3.2 | 9.5 | 9.7 | pass |
| Example 10 | 91.7995 | 5.0000 | 3.0000 | 0.2000 | 0.0005 | 8.2 | 1.9 | 9.4 | 9.8 | pass |

TABLE 2-continued

| Samples | Zn atm % | Co atm % | Pr atm % | Ca atm % | Na atm % | V1mA (V) | Id(3 V) (nA) | ΔC/C (85° C.) (%) | tan δ @85° C. (%) | Evaluation |
|---|---|---|---|---|---|---|---|---|---|---|
| Example 11 | 89.7995 | 5.0000 | 5.0000 | 0.2000 | 0.0005 | 8.1 | 3.2 | 9.6 | 10 | pass |
| Comparative Example 6 | 84.7995 | 5.0000 | 10.0000 | 0.2000 | 0.0005 | 8.2 | 219.8 | 19.1 | 19.1 | fail |
| Example 12 | 94.7499 | 5.0000 | 0.0500 | 0.2000 | 0.0001 | 8.0 | 2.8 | 9.5 | 9.9 | pass |
| Example 13 | 89.7999 | 5.0000 | 5.0000 | 0.2000 | 0.0001 | 8.1 | 3.2 | 9.4 | 9.5 | pass |
| Example 14 | 94.7492 | 5.0000 | 0.0500 | 0.2000 | 0.0008 | 8.2 | 2.3 | 9.0 | 9.7 | pass |
| Example 15 | 89.7992 | 5.0000 | 5.0000 | 0.2000 | 0.0008 | 8.1 | 4.3 | 9.1 | 9.9 | pass |

Table 3 shows measuring results wherein the Pr and Ca concentration were maintained constant to 2.0 and 0.2 atm % respectively, while changing the Co concentration. The Na concentration was set constant to 0.0005 atm % in comparative examples 7 to 9.

Figure 4:
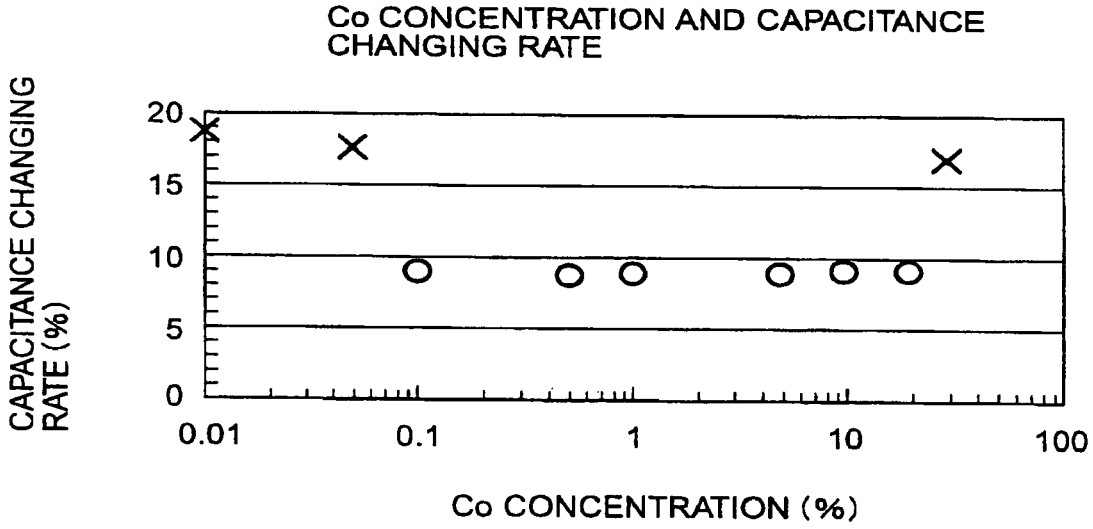
FIG. 4 is a graph showing Co concentration dependency of the capacitance changing rate of the voltage non-linear resistance element according to the example of the present invention.

Also, in examples 22 to 25, the Na concentration was either set to 0.0001 atm % or 0.0008 atm %. FIG. 4 is a graph illustrating the relationship between the capacitance changing rate and the Co concentration in examples 16 to 21 and comparative examples 7 to 9.

From these results, the capacitance changing rate and the dielectric tangent loss were 10% or less and 15% or less respectively within the range of Co concentration being 0.1 to 20 atm %. At the same time, the leakage current was also maintained to 10 nA or less.

At this condition, the varistor voltages were all the same. In comparative examples 7 to 9, even though the varistor voltage was the same, the capacitance changing rate, the dielectric tangent loss and the leakage current were larger compared to the examples. Also, same effects were obtained in examples 22 to 25 wherein the Na concentration was either set to 0.0001 atm % or 0.0008 atm %.

respectively, while changing the Ca concentration. In examples 26 to 33 and comparative examples 10 and 11, the Na concentration was set constant to 0.0005 atm %.

Also, in examples 34 to 37, Na concentration was either set to 0.0001 atm % or 0.0008 atm %.

Figure 5:
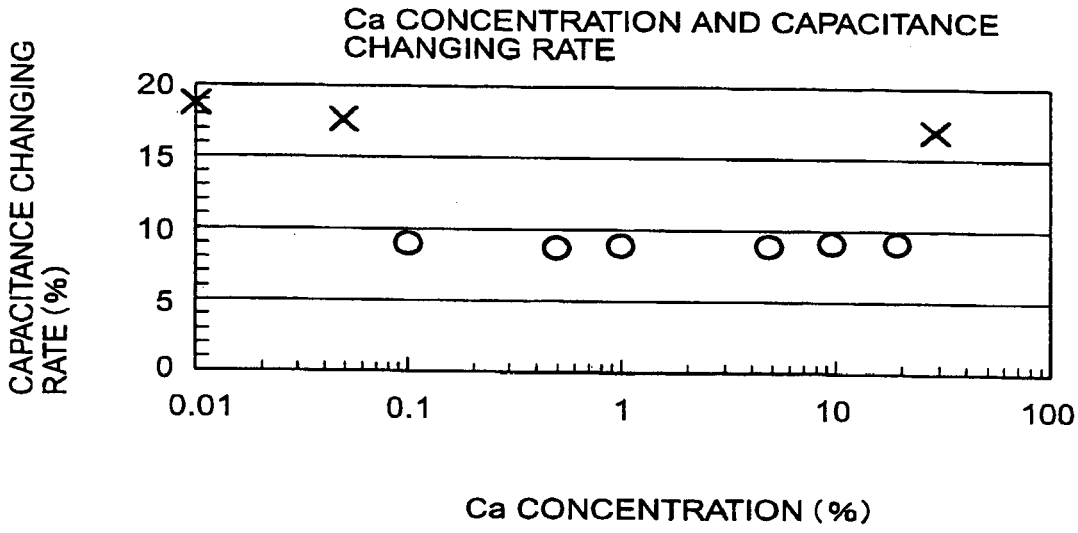
FIG. 5 is a graph showing Ca concentration dependency of the capacitance changing rate of the voltage non-linear resistance element according to the example of the present invention.

FIG. 5 shows a graph illustrating the relationship between the capacitance changing rate and Ca concentration in examples 26 to 33 and comparative examples 10 and 11.

From these results, within the range of Ca concentration being 0.01 to 5.0 atm % (examples 26 to 33), the capacitance changing rate and the dielectric tangent loss were 10% or less and 15% or less respectively. At the same time, the leakage current was maintained 10 nA or less (in fact it was less than 5 nA). At this condition, the varistor voltages were all the same.

In comparative examples 10 and 11, although the varistor voltages were the same, the capacitance changing rate, the dielectric tangent loss and the leakage current were larger than the examples. Also, the same effect was obtained at this

TABLE 3

| Samples | Zn atm % | Co atm % | Pr atm % | Ca atm % | Na atm % | V1mA (V) | Id(3 V) (nA) | ΔC/C (85° C.) (%) | tan δ @85° C. (%) | Evaluation |
|---|---|---|---|---|---|---|---|---|---|---|
| Comparative Example 7 | 97.7895 | 0.0100 | 2.0000 | 0.2000 | 0.0005 | 8.2 | 102.2 | 18.8 | 24.2 | fail |
| Comparative Example 8 | 97.7495 | 0.0500 | 2.0000 | 0.2000 | 0.0005 | 7.9 | 98.2 | 17.5 | 23.1 | fail |
| Example 16 | 97.6995 | 0.1000 | 2.0000 | 0.2000 | 0.0005 | 8.1 | 2.3 | 9.1 | 12.6 | pass |
| Example 17 | 97.2995 | 0.5000 | 2.0000 | 0.2000 | 0.0005 | 7.9 | 3.2 | 8.7 | 9.5 | pass |
| Example 18 | 96.7995 | 1.0000 | 2.0000 | 0.2000 | 0.0005 | 8.2 | 2.1 | 8.8 | 9.1 | pass |
| Example 19 | 92.7995 | 5.0000 | 2.0000 | 0.2000 | 0.0005 | 7.9 | 0.9 | 8.9 | 9.6 | pass |
| Example 20 | 87.7995 | 10.0000 | 2.0000 | 0.2000 | 0.0005 | 8.1 | 2.4 | 9.1 | 9.3 | pass |
| Example 21 | 77.7995 | 20.0000 | 2.0000 | 0.2000 | 0.0005 | 8.1 | 2.8 | 9.2 | 8.9 | pass |
| Comparative Example 9 | 67.7995 | 30.0000 | 2.0000 | 02000 | 0.0005 | 8.0 | 78.2 | 16.8 | 17.9 | fail |
| Example 22 | 97.6999 | 0.1000 | 2.0000 | 0.2000 | 0.0001 | 8.2 | 1.9 | 9.8 | 10.1 | pass |
| Example 23 | 77.7999 | 20.0000 | 2.0000 | 0.2000 | 0.0001 | 7.9 | 3.2 | 9.5 | 9.9 | pass |
| Example 24 | 97.6992 | 0.1000 | 2.0000 | 0.2000 | 0.0008 | 8.1 | 2.3 | 9.3 | 10.0 | pass |
| Example 25 | 77.7992 | 20.0000 | 2.0000 | 0.2000 | 0.0008 | 8.1 | 2.6 | 9.5 | 9.8 | pass |

Table 4 shows measuring results wherein the Pr and Co concentrations were maintained constant to 2.0 and 5.0 atm % Ca concentration in examples 34 to 37 wherein the Na concentration was either 0.0001 atm % or 0.0008 atm %.

TABLE 4

| Samples | Zn atm % | Co atm % | Pr atm % | Ca atm % | Na atm % | V1mA (V) | Id(3 V) (nA) | ΔC/C (85° C.) (%) | tan δ @85° C. (%) | Evaluation |
|---|---|---|---|---|---|---|---|---|---|---|
| Comparative Example 10 | 92.9945 | 5.0000 | 2.0000 | 0.0050 | 0.0005 | 8.1 | 138.9 | 16.6 | 25.3 | fail |
| Example 26 | 92.9895 | 5.0000 | 2.0000 | 0.0100 | 0.0005 | 8.2 | 2.2 | 9.1 | 9.9 | pass |
| Example 27 | 92.9495 | 5.0000 | 2.0000 | 0.0500 | 0.0005 | 7.9 | 3.8 | 8.9 | 10 | pass |
| Example 28 | 92.8995 | 5.0000 | 2.0000 | 0.1000 | 0.0005 | 8.0 | 3.3 | 8.8 | 9.8 | pass |
| Example 29 | 92.4995 | 5.0000 | 2.0000 | 0.5000 | 0.0005 | 8.1 | 1.9 | 9 | 9.6 | pass |
| Example 30 | 91.9995 | 5.0000 | 2.0000 | 1.0000 | 0.0005 | 8.2 | 2.3 | 9 | 9.7 | pass |
| Example 31 | 90.9995 | 5.0000 | 2.0000 | 2.0000 | 0.0005 | 8.1 | 1.9 | 8 | 8.3 | pass |

TABLE 4-continued

| Samples | Zn atm % | Co atm % | Pr atm % | Ca atm % | Na atm % | V1mA (V) | Id(3 V) (nA) | ΔC/C (85° C.) (%) | tan δ @85° C. (%) | Evaluation |
|---|---|---|---|---|---|---|---|---|---|---|
| Example 32 | 89.9995 | 5.0000 | 2.0000 | 3.0000 | 0.0005 | 8.1 | 2.1 | 8.8 | 9.7 | pass |
| Example 33 | 87.9995 | 5.0000 | 2.0000 | 5.0000 | 0.0005 | 8.0 | 2.5 | 8.7 | 9.9 | pass |
| Comparative Example 11 | 85.9995 | 5.0000 | 2.0000 | 7.0000 | 0.0005 | 8.1 | 121.1 | 15.1 | 21.2 | fail |
| Example 34 | 92.9899 | 5.0000 | 2.0000 | 0.0100 | 0.0001 | 8.2 | 2.9 | 8.8 | 9.6 | pass |
| Example 35 | 87.9999 | 5.0000 | 2.0000 | 5.0000 | 0.0001 | 7.9 | 3.2 | 9.1 | 9.8 | pass |
| Example 36 | 92.9892 | 5.0000 | 2.0000 | 0.0100 | 0.0008 | 8.1 | 2.4 | 9.2 | 9.9 | pass |
| Example 37 | 87.9992 | 5.0000 | 2.0000 | 5.0000 | 0.0008 | 8.0 | 2.1 | 9 | 9.9 | pass |

Next, as for the further additives, K, Al, Cr, and Si with 0.001 to 1.0 atm %, 0.001 to 0.5 atm %, 0.01 to 1.0 atm %, and 0.001 to 0.5 atm % were added respectively and the same characteristics were measured (examples 38 to 46). Here, the concentrations of Co, Pr, Ca, and Na were 5.0, 2.0, 0.2, and 0.0005 atm % respectively. Also, in order for the comparison, Cr in the example 46 was substituted with Mo in comparative example 12.

Table 5 shows measuring results of examples 38 to 46 and comparative 12. From these results, even when K, Al, Cr and Si were further added in the above range, the capacitance changing rate and the dielectric tangent loss were as low as 10% or less and 15% or less respectively. At the same time, the leakage current was maintained 10 nA or less (in fact it was less than 5 nA). The varistor voltages were the same. When the Cr is substituted with Mo, the leakage current was confirmed to be larger.

TABLE 5

| Samples | Zn atm % | Co atm % | Pr atm % | Ca atm % | K atm % | Al atm % | Cr atm % | Si atm % | V1mA (V) | Id(3 V) (nA) | ΔC/C (85° C.) (%) | tan δ @85° C. (%) | Evaluation |
|---|---|---|---|---|---|---|---|---|---|---|---|---|---|
| Example 38 | 92.5300 | 5.0000 | 2.0000 | 0.2000 | 0.0400 | 0.1000 | 0.0300 | 0.1000 | 8.1 | 2.3 | 9.0 | 9.8 | pass |
| Example 39 | 92.5690 | 5.0000 | 2.0000 | 0.2000 | 0.0010 | 0.1000 | 0.0300 | 0.1000 | 8.2 | 2.1 | 9.0 | 9.8 | pass |
| Example 40 | 91.5700 | 5.0000 | 2.0000 | 0.2000 | 1.0000 | 0.1000 | 0.0300 | 0.1000 | 8.0 | 1.9 | 8.7 | 9.9 | pass |
| Example 41 | 92.6290 | 5.0000 | 2.0000 | 0.2000 | 0.0400 | 0.0010 | 0.0300 | 0.1000 | 8.1 | 2.0 | 8.8 | 9.9 | pass |
| Example 42 | 92.1300 | 5.0000 | 2.0000 | 0.2000 | 0.0400 | 0.5000 | 0.0300 | 0.1000 | 8.2 | 1.9 | 9.0 | 9.8 | pass |
| Example 43 | 92.5500 | 5.0000 | 2.0000 | 0.2000 | 0.0400 | 0.1000 | 0.0100 | 0.1000 | 8.2 | 2.4 | 9.1 | 9.9 | pass |
| Example 44 | 91.5600 | 5.0000 | 2.0000 | 0.2000 | 0.0400 | 0.1000 | 1.0000 | 0.1000 | 7.9 | 2.3 | 8.8 | 9.9 | pass |
| Example 45 | 92.6290 | 5.0000 | 2.0000 | 0.2000 | 0.0400 | 0.1000 | 0.0300 | 0.0010 | 8.1 | 4.2 | 8.9 | 10.1 | pass |
| Example 46 | 92.7600 | 5.0000 | 2.0000 | 0.2000 | 0.0400 | 0.1000 | 0.0300 | 0.5000 | 8.2 | 3.2 | 9.2 | 9.9 | pass |
| Comparative Example 12 | 92.7600 | 5.0000 | 2.0000 | 0.2000 | 0.0400 | 0.1000 | Mo0.03 | 0.5000 | 8.2 | 119.5 | 15.0 | 20.2 | fail |

Therefore, the capacitance changing rates in all examples were confirmed to become smaller. In the comparative examples having the composition out of the range of the present invention, the capacitance changing rate was larger. Also, the dielectric tangent loss and leakage current were confirmed to be small in all examples as well as the capacitance changing rate.

The invention claimed is:

1. A voltage non-linear resistance ceramic composition comprising:

zinc oxide as a main component, 0.05 to 5 atm % of Pr, 0.1 to 20 atm % of Co, 0.01 to 5 atm % of Ca and 0.0001 to 0.0008 atm % of Na.

2. A voltage non-linear resistance element comprising said voltage non-linear resistance ceramic composition as set forth in claim 1.

3. The voltage non-linear resistance element as set forth in claim 2 comprising a sintered body of said voltage non-linear resistance ceramic composition and plurality of electrodes connected to said sintered body.

4. The voltage non-linear resistance element as set forth in claim 2 comprising a multilayer structure having resistance element layers comprised of said voltage non-linear resistance ceramic composition and internal electrodes stacked in alternating manner wherein each of said internal electrode facing each other across said resistance element layer are connected to either one of external terminal electrode which are formed on the side end of said multilayer structure.

5. The voltage non-linear resistance ceramic composition of claim 1, wherein the Na is mixed in the composition.

6. A voltage non-linear resistance element comprising said voltage non-linear resistance ceramic composition as set forth in claim 5.

7. A voltage non-linear resistance ceramic composition comprising:

zinc oxide as a main component, 0.05 to 5 atm % of Pr, 0.1 to 20 atm % of Co, 0.01 to 5 atm % of Ca and 0.0001 to 0.0008 atm % of Na, 0.001 to 1 atm % of K, 0.001 to 0.5 atm % of Al, 0.01 to 1 atm % of Cr and 0.001 to 0.5 atm % of Si.

8. A voltage non-linear resistance element comprising said voltage non-linear resistance ceramic composition as set forth in claim 7.

9. The voltage non-linear resistance element as set forth in claim 8 comprising a sintered body of said voltage non-linear resistance ceramic composition and plurality of electrodes connected to said sintered body.

10. The voltage non-linear resistance element as set forth in claim 8 comprising a multilayer structure having resistance element layers comprised of said voltage non-linear resistance ceramic composition and internal electrodes stacked in alternating manner wherein each of said internal electrode facing each other across said resistance element layer are connected to either one of external terminal electrode which are formed on the side end of said multilayer structure.

11. The voltage non-linear resistance ceramic composition of claim 7, wherein the Na is mixed in the composition.

12. A voltage non-linear resistance element comprising said voltage non-linear resistance ceramic composition as set forth in claim 11.

* * * * *